US008983313B2

(12) United States Patent
Makino

(10) Patent No.: US 8,983,313 B2
(45) Date of Patent: Mar. 17, 2015

(54) IMAGE HEATING DEVICE

(71) Applicant: Canon Kabushiki Kaisha, Tokyo (JP)

(72) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/207,946

(22) Filed: Mar. 13, 2014

(65) Prior Publication Data

US 2014/0286655 A1 Sep. 25, 2014

(30) Foreign Application Priority Data

Mar. 19, 2013 (JP) ..... 2013-056225

(51) Int. Cl.
*G03G 15/20* (2006.01)
*G03G 15/16* (2006.01)
*G03G 15/00* (2006.01)

(52) U.S. Cl.
CPC ..... *G03G 15/2039* (2013.01); *G03G 15/50* (2013.01)
USPC ..... 399/33; 399/122

(58) Field of Classification Search
USPC ..... 399/33, 122, 107, 329
See application file for complete search history.

(56) References Cited

U.S. PATENT DOCUMENTS

2012/0263509 A1* 10/2012 Yokoyama ..... 399/329

FOREIGN PATENT DOCUMENTS

JP 2002-287542 A 10/2002

* cited by examiner

*Primary Examiner* — Billy Lactaoen
(74) *Attorney, Agent, or Firm* — Canon USA, Inc., IP Division

(57) ABSTRACT

An image heating device includes a belt, a wire stretched from one widthwise end to the other widthwise end of the belt near a peripheral surface of the belt, a moving member movably fixed to one end of the wire, a biasing member, a detection unit, and a control unit. The belt heats an image on a sheet. The biasing member biases the moving member. The detection unit detects, from a biasing force of the biasing member provided when the wire is cut, that the moving member is moved. The control unit controls, according to an output of the detection unit with regard to detecting that the moving member is moved, whether or not to prohibit an image heating process.

6 Claims, 8 Drawing Sheets

IMAGE HEATING DEVICE

BACKGROUND OF THE INVENTION

1. Field of the Invention

The present invention relates to an image heating device that heats an image on a sheet.

2. Description of the Related Art

An image forming apparatus, such as a printer, a copying machine, a facsimile machine, or a multi-functional apparatus of these machines, which includes a fixing device (an image heating device) of a belt heating type using a fixing belt (an endless belt) has hitherto been put into practical use. In such a fixing device, a toner image, which is formed and born on a sheet (a recording material) by an image forming method such as an electrophotographic process or an electrostatic recording process, is fixed on a surface of the recording material by heating.

Since such a fixing device of the belt heating type uses a thin fixing belt having low heat capacity and high thermal responsiveness, the temperature of the fixing belt can reach a fixing temperature in a short time from power-on. This greatly contributes to power saving of the image forming apparatus.

However, the thin fixing belt may be broken owing to deformation or a flaw caused by any external force. If the fixing belt is broken, not only an image defect may be caused, but also a broken part may contact and break other components. Therefore, if the fixing belt is broken, it is preferable to immediately understand the fact and to prohibit a fixing process (an image heating process). A technique for that purpose is proposed in Japanese Patent Laid-Open No. 2002-287542.

Specifically, in a fixing device described in Japanese Patent Laid-Open No. 2002-287542, a belt mark is put on a fixing belt, and an optical sensor is disposed on a side opposed thereto. With this structure, it is determined that the fixing belt is broken when the optical sensor does not detect the belt mark for a fixed time.

However, in the fixing device described in Japanese Patent Laid-Open No. 2002-287542, if a flaw is made on the belt mark or a foreign substance adheres to the belt mark, the amount of light (amount of reflected light) received by the optical sensor decreases and becomes unstable. Hence, a breakage of the fixing belt may be detected erroneously.

SUMMARY OF THE INVENTION

Aspects of the present invention provide an image heating device including a belt configured to heat an image on a sheet, a wire stretched from one widthwise end to the other widthwise end of the belt near a peripheral surface of the belt, a moving member movably fixed to one end of the wire, a biasing member configured to bias the moving member, a detection unit configured to detect that the moving member is moved by a biasing force of the biasing member with being cut of the wire, and a control unit configured to control, according to an output of the detection unit with regard to detecting that the moving member is moved, whether or not to prohibit an image heating process.

Further features of the present invention will become apparent from the following description of exemplary embodiments with reference to the attached drawings.

DESCRIPTION OF THE EMBODIMENTS

An embodiment of the present invention will be described below with reference to the drawings. While an image heating device of the embodiment is applied to a fixing device that fixes an unfixed toner image onto a sheet (a recording material), the present invention is also applicable to a heat treatment device that heats a recording material bearing a fixed image or a semi-fixed image to adjust the surface texture of the image. The dimensions, materials, shapes, and relative arrangements of the constituent components adopted in the embodiment should be appropriately changed according to the configuration and various conditions of the device to which the present invention is applied, and are not intended to be limited to the following embodiment.

Figure 2:
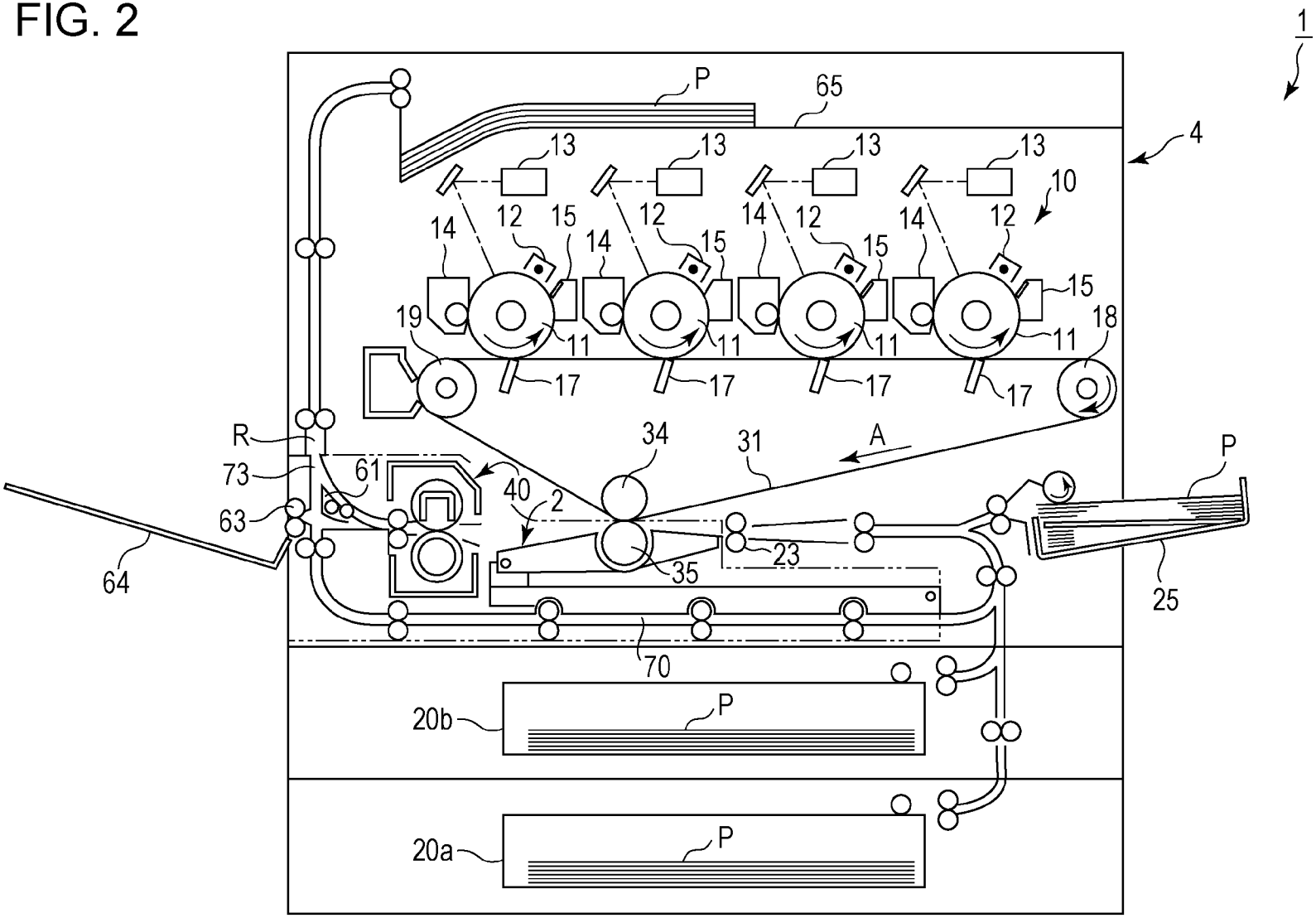
FIG. 2 is a schematic configuration view of an image forming apparatus including the fixing device.

First, an electrophotographic color printer serving as an image forming apparatus will be described with reference to FIG. 2. FIG. 2 is a cross-sectional view of the electrophotographic color printer, taken along a sheet conveying direction. In the following description of the embodiment, the electrophotographic color printer will be simply referred to as a "printer."

[Printer]

As illustrated in FIG. 2, a printer 1 includes a printer main body 4. The printer main body 4 includes image forming sections 10 corresponding to Y (yellow), M (magenta), C (cyan), and Bk (black) colors. Each of the image forming sections 10 includes a photosensitive drum 11, and a charger 12, a laser scanner 13, a developing unit 14, a primary transfer blade 17, and a cleaner 15 that are arranged in order in a rotating direction of the photosensitive drum 11.

In each of the image forming sections 10, the photosensitive drum 11 is charged by the charger 12 beforehand, and an electrostatic latent image is formed thereon by the laser scanner 13. The electrostatic latent image is developed into a visible toner image by the developing unit 14. Toner images formed on the photosensitive drums 11 corresponding to the colors are each sequentially transferred by the primary transfer blade 17 onto an intermediate transfer belt 31 serving as an image bearing member so as to form a color toner image. After this transfer, toner remaining on each photosensitive drum 11 is removed by the cleaner 15. Hence, a surface of the photosensitive drum 11 is cleaned and can prepare for the next image forming operation.

In contrast, recording materials P are fed one by one from a first sheet cassette 20*a*, a second sheet cassette 20*b*, or a multipurpose sheet tray 25 provided on one side of the printer 1, and a fed recording material P is sent between a pair of registration rollers 23. The registration rollers 23 temporarily receive the recording material P and correct skew feeding. Then, the registration rollers 23 send the recording material P into a secondary transfer nip between the intermediate transfer belt 31 and a secondary transfer roller 35 in synchronization with the toner image on the intermediate transfer belt 31. The intermediate transfer belt 31 is supported by tension rollers 18, 19, and 34 to be rotatable in a direction of arrow A.

The color toner image on the intermediate transfer belt 31 is transferred onto the recording material P by the secondary transfer roller 35 serving as a transfer member. After that, the recording material P is heated and pressed by a fixing device 40, and a toner image t (see FIG. 1) is fixed on the recording material (sheet) P. In FIG. 2, reference numeral 2 denotes a pre-fixing guide that guides the recording material P to the fixing device 40 before fixing.

When a toner image is to be formed on one side of the recording material P, a conveyance path is switched by a switch member (flapper) 61 according to the condition. When the recording material P is to be discharged face up (the toner image faces up), it is discharged via sheet discharge rollers 63 onto a sheet discharge tray 64 disposed on a side surface of the printer 1. In contrast, when the recording material P is to be discharged face down (the toner image faces down), it is discharged onto a sheet discharge tray 65 disposed in an upper part of the printer 1.

When a toner image is to be formed on each side of the recording material P, after a toner image is fixed on one side of the recording material P by the fixing device 40, the recording material P is guided upward by the switched switch member 61, and is turned upside down by being switched back into a switchback conveyance path 73 when a trailing edge of the recording material P reaches a reverse point R. After that, the recording material P is conveyed through a duplex conveyance path 70, and a toner image is formed on the other side of the recording material P through a process similar to that for one-sided image formation. Then, the recording material P is discharged onto the sheet discharge tray 64 or the sheet discharge tray 65. A section constituted by the switch member 61, the switchback conveyance path 73, etc. is an example of a reversing unit.

[Fixing Device]

Figure 1:
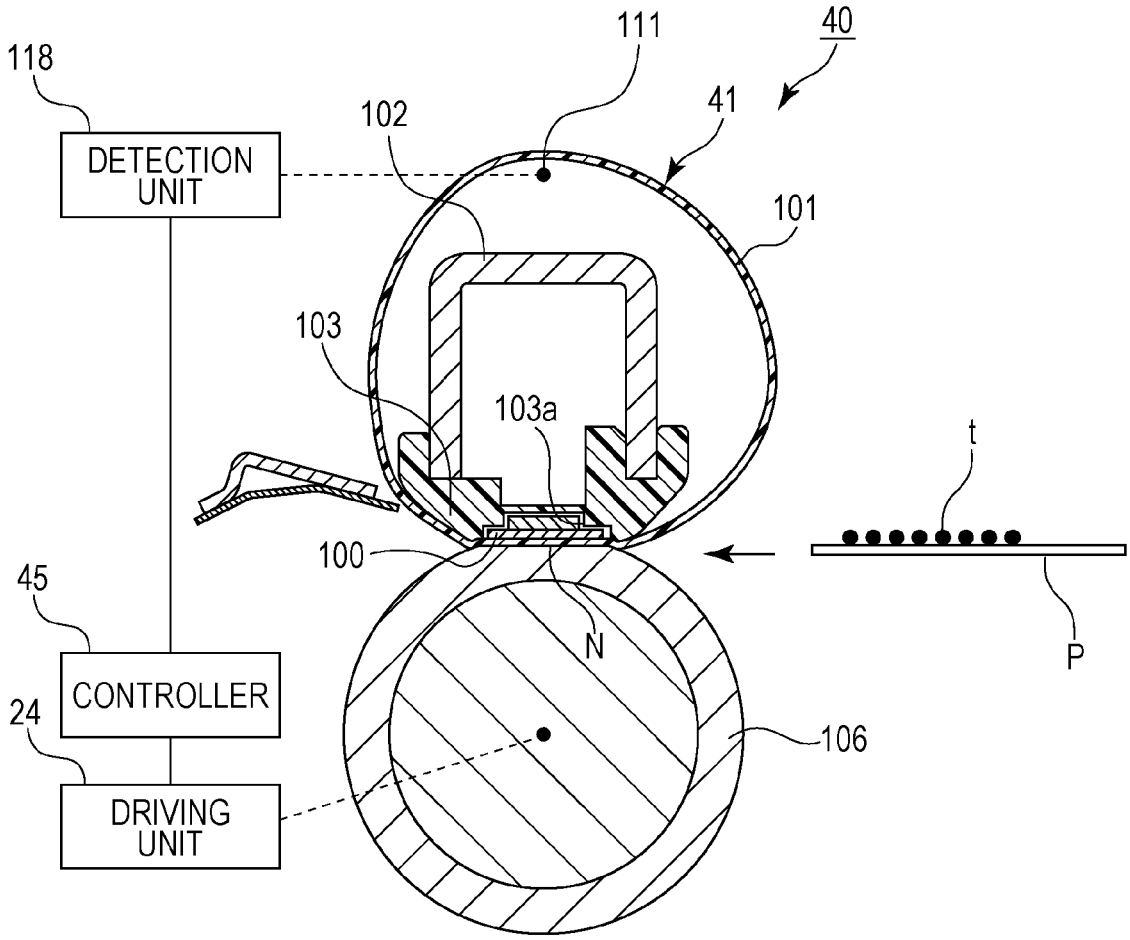
FIG. 1 is a schematic cross-sectional view of a fixing device.
Figure 3:
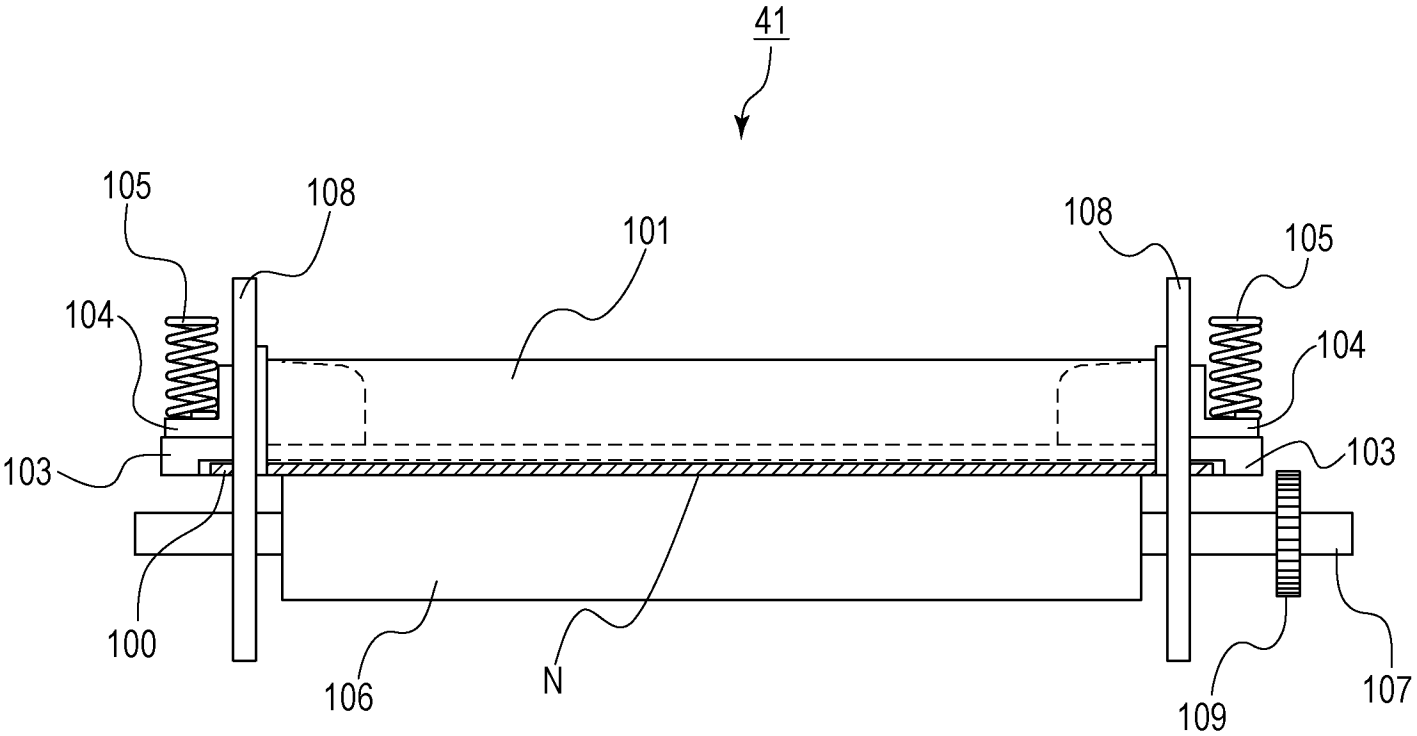
FIG. 3 is a side view of the fixing device.

Next, the fixing device 40 will be described with reference to FIGS. 1 and 3. FIG. 1 is a schematic cross-sectional view of the fixing device 40, taken along the sheet conveying direction, and FIG. 3 is a side view of the fixing device 40, as viewed from a right side of FIG. 1.

The fixing device 40 is an example of a belt heating type fixing device. The fixing device 40 includes a pressing roller 106 serving as a driving rotating member or a rotating member, and a fixing unit 41 opposed to the pressing roller 106 and serving as an image heating member. The fixing unit 41 includes a ceramic heater 100 serving as a heating mechanism therein. The pressing roller 106 serving as the driving rotating member forms a fixing nip (nip) N in cooperation with a fixing belt 101 serving as an endless belt, and drives the fixing belt 101.

The fixing unit 41 includes a cylindrical fixing film (hereinafter referred to as a fixing belt) 101 serving as an endless belt, and a guide member 103 that forms the fixing nip N with the pressing roller 106 such that the fixing belt 101 is located therebetween. The guide member 103 extends long to have a length nearly equal to an axial length of the fixing belt 101 and the pressing roller 106. The fixing belt 101 is heated by the ceramic heater 100 (heating member) and is supported to be rotatable in a circumferential direction. The pressing roller (rotating member) 106 is rotatably supported while forming the fixing nip (nip) N by contact with the fixing belt 101.

The fixing unit 41 further includes fixing flanges 104 and a stay 102. The fixing flanges 104 are disposed at both axial ends of the fixing belt 101, respectively, to regulate a circumferential track of the fixing belt 101. The stay 102 is disposed on an inner surface side of the fixing belt 101 to ensure strength of the guide member 103.

The fixing device 40 includes a controller 45 formed by a CPU and serving as a control unit, a detection unit 118 serving as a cut detection unit connected to the controller 45, and a driving unit 24, such as a motor, connected to the controller 45 to rotationally drive the pressing roller 106. The detection unit 118 also functions as a detection unit for detecting a conductive state of a wire 111, and the controller 45 functions as a prohibition unit. The controller 45 serving as the prohibition unit prohibits an image heating process when the detection unit 118 detects that the wire 111 is in a non-conductive state. For example, the controller 45 prohibits the image heating process by at least one of a method of stopping a heating operation with a heating member, such as the ceramic heater 100, and a method of stopping driving of the pressing roller 106.

The members will be described in detail below. First, the members that constitute the fixing unit 41 will be described.

The fixing belt 101 in the fixing unit 41 is formed by a heat-resistant cylindrical member that transfers heat to a recording material P, and is loosely fitted on the guide member 103. For example, the fixing belt 101 can be formed by a thin metal film having a thickness within the range of 20 to 100 μm, preferably to 50 μm. As the thin metal film, a composite-layer film obtained by coating an outer peripheral surface of SUS with PTFE, PFA, or FEP, can be used, for example.

On an inner side of the fixing belt 101, the guide member 103 is disposed to extend long with a length slightly more than the longitudinal length of the fixing belt 101. The guide member 103 is formed of a heat-resistant and heat-insulating material. As this material, a material that has high insulation and high heat resistance, such as phenol resin, polyimide resin, polyamide resin, polyamideimide resin, PEEK resin, PES resin, PPS resin, PFA resin, PTFE resin, or LCP resin, can be used. The guide member 103 is in pressure contact with the pressing roller 106 to assist pressurization at the fixing nip N formed between the fixing belt 101 and the pressing roller 106 and to function as a guide for stabilizing the rotation of the fixing belt 101.

In a lower surface of the guide member 103 in FIG. 1, a fitting groove 103*a* extends in the longitudinal direction. The ceramic heater 100 having a length nearly equal to the length of the fitting groove 103*a* is fitted and supported in the fitting groove 103*a*. The ceramic heater 100 is a heating member having a low heat capacity, and is increased in temperature with a totally steep rise characteristic by energization of a heating resistor layer. For example, in the ceramic heater 100, an energizing heating resistor layer is provided on a ceramic substrate shaped like an elongated thin plate.

The stay 102 is disposed on the guide member 103. The stay 102 has a length nearly equal to the longitudinal length of the guide member 103. The stay 102 is pressed against a back surface of the guide member 103 made of comparatively soft resin to impart longitudinal strength to the guide member 103 and to correct the guide member 103.

The fixing flanges 104 and 104 are fitted in both longitudinal ends of the stay 102, respectively. These fixing flanges 104 have side wall portions that guide the circumferential rotation of the fixing belt 101 and function as thrust stops for regulating movement of the fixing belt 101 in the widthwise direction (right-left direction in FIG. 3). The fixing flanges 104 are fitted in and held by side plates 108 disposed at both axial ends of the fixing belt 101 and the pressing roller 106, respectively. This ensures the position of the entire fixing unit 41.

Pressing springs 105 and 105 are disposed on outer sides of the side plates 108 and 108 at both ends, respectively. These pressing springs 105 and 105 impart a predetermined pressing force to the fixing flanges 104 and 104 at both ends of the fixing belt 101. The pressing roller 106 located on a lower side of the fixing belt 101 is supported by the side plates 108 provided at both axial ends such that a rotation shaft (a cored bar 107) thereof is rotatable. The pressing roller 106 is also pressed toward the fixing belt 101 by an unillustrated pressing mechanism to form the fixing nip N.

Next, the pressing roller (rotating member) 106 serving as the pressing member will be described in detail with reference to FIG. 3.

That is, as illustrated in FIG. 3, the pressing roller 106 includes the cored bar 107 that extends in an axial direction (a right-left direction in FIG. 3) to serve as a rotation shaft for the pressing roller 106, and a roller-shaped covering layer provided around the cored bar 107. The covering layer is molded integrally and concentrically with the cored bar 107 to cover the cored bar 107. A release layer is provided on a surface of the pressing roller 106. The covering layer provided around the cored bar 107 is formed of a heat-resistant elastic material such as silicone rubber, fluoro rubber, or fluoro resin. As the release layer, a material having high releasability and high heat resistance, such as fluoro resin, silicone resin, fluoro silicone rubber, fluoro rubber, silicone rubber, PFA, PTFE, or FEP, can be selected.

Unillustrated bearing members formed of a heat-resistant resin, such as PEEK, PPS, or a liquid crystal polymer, are attached to both ends of the cored bar 107, respectively. These bearing members allow the cored bar 107 to be rotatably held in the side plates 108 and 108. A gear 109 is attached to one longitudinal end of the cored bar 107. The pressing roller 106 is rotationally driven by the rotation received from the driving unit 24, which is controlled by the controller 45 (FIG. 1), to the cored bar 107 via the gear 109. When the pressing roller 106 rotates, the fixing belt 101 in contact with the pressing roller 106 drags (rotates) along with the rotation of the pressing roller 106.

[Cut Detection Mechanism]

Figure 4:
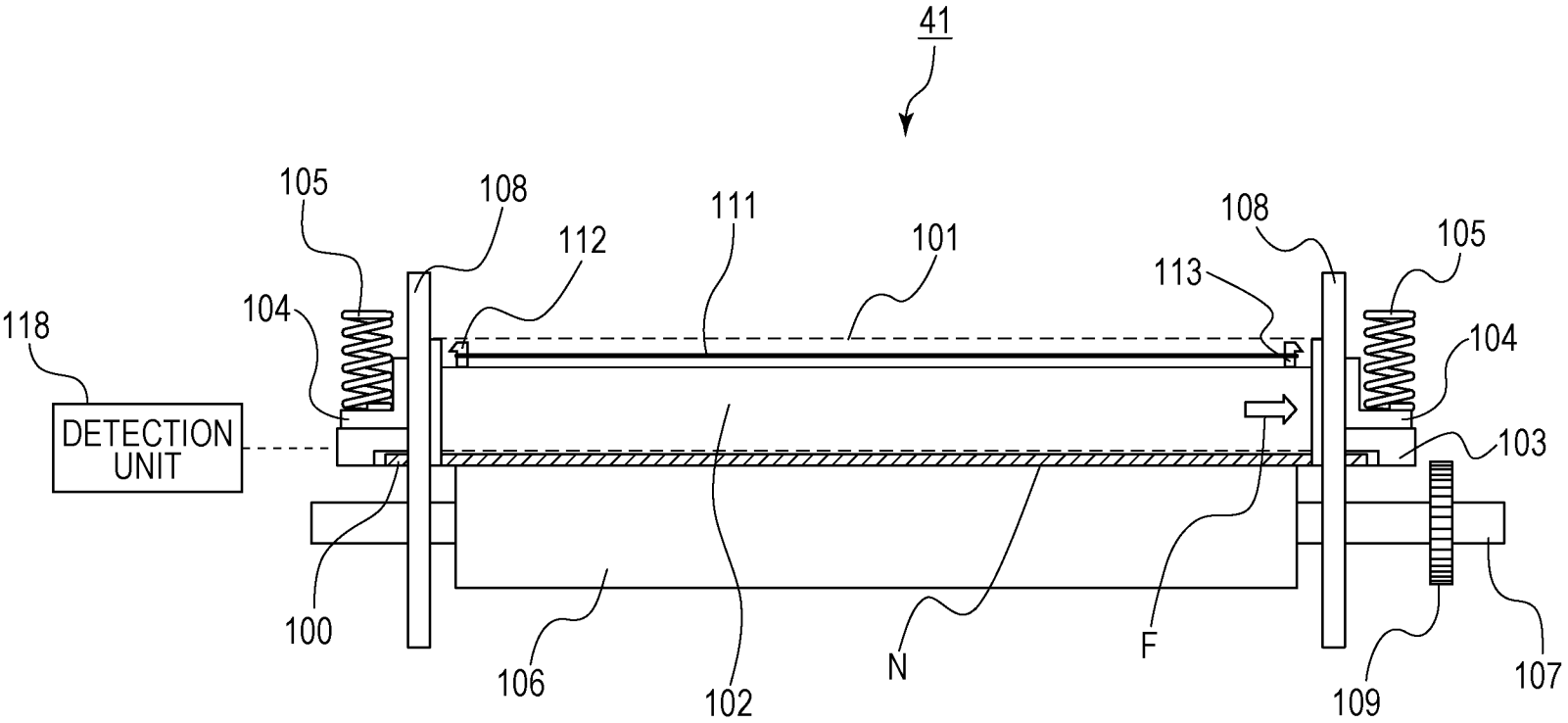
FIG. 4 is a side view of the fixing device, illustrating a suspended member.

Next, a cut detection mechanism for detecting a breakage (cut) of the fixing belt 101 will be described with reference to FIGS. 4 and 5. FIG. 4 is a side view of a wire 111 serving as a suspended member, and FIG. 5 is an exploded perspective view illustrating an internal structure of the fixing belt 101.

Figure 5:
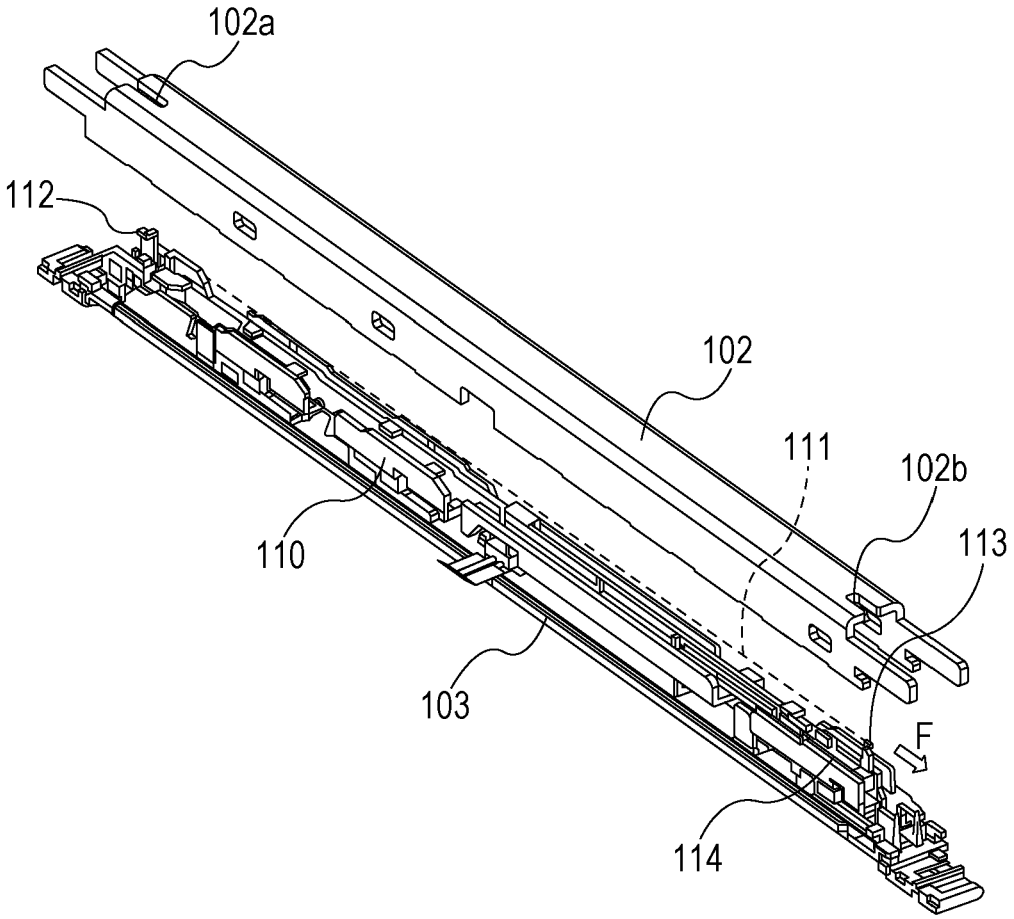
FIG. 5 is an exploded perspective view illustrating the interior of a fixing unit.

That is, as illustrated in FIGS. 4 and 5, the cut detection mechanism includes the wire 111 serving as the suspended member. The wire 111 is laid in the longitudinal direction of the fixing belt 101 such as to be close to an inner peripheral surface of the fixing belt 101. The detection unit 118 connected to the controller 45 (FIG. 1) is connected to the cut detection mechanism, and detects that the wire 111 is cut.

The controller (control unit) 45 controls the members of the fixing device 40, and determines, on the basis of detection of the detection unit (cut detection unit) 118, that the fixing belt (endless belt) 101 is broken. The detection unit 118 serves to detect that the wire 111 provided in the fixing belt 101 is cut. When determining, on the basis of the detection of the detection unit 118, that the fixing belt 101 is broken, the controller 45 stops driving of the driving unit 24 (FIG. 1) to stop the pressing roller 106, and to stop the rotation of the fixing belt 101.

A fixed-side support member 112 and a movable-side support member 113 serving as a pair of support portions for supporting both ends of the suspended member are disposed at both longitudinal ends of the guide member 103, respectively. The fixed-side support member 112 is fixedly supported at one end of the guide member 103, and the movable-side support member 113 is supported at the other end of the guide member 103 such as to be movable in a direction of arrow F.

The stay 102 disposed to cover an upper part of the guide member 103 has long grooves 102*a* and 102*b* at both longitudinal ends, respectively. A distal end portion of the fixed-side support member 112 and a distal end portion of the movable-side support member 113 penetrate the long grooves 102*a* and 102*b*, respectively. In this state, the wire (suspended member) 111 is laid between the fixed-side support member 112 and the movable-side support member 113 such as to be located slightly above the stay 102. That is, the wire 111 is stretched from one widthwise end to the other widthwise end of the fixing belt 101 near the peripheral surface of the fixing belt 101.

Thus, in a state in which the wire 111 is suspended between both widthwise ends of the fixing belt 101 to pass near the inner peripheral surface of the fixing belt 101, it can be cut when the fixing belt 101 breaks and a broken part thereof contacts the wire 111. The strength of the wire 111 is set at a degree such that the wire 111 is cut when the broken part of the fixing belt 101 contacts the wire 111.

In the above-described support structure, the wire 111 supported by the fixed-side support member 112 and the movable-side support member 113 is disposed to extend over the entire longitudinal range of the fixing belt 101. Thus, the wire 111 can be cut even when the fixing belt 101 is broken at any longitudinal position.

By changing the support structure including the fixed-side support member 112 and the movable-side support member 113, the wire 111 can be suspended between both widthwise ends of the fixing belt 101 to pass near an outer peripheral surface of the fixing belt 101. In this case, although the wire 111 is cut on the outer peripheral side of the fixing belt 101 when the fixing belt 101 is broken, advantages similar to the following advantages can be obtained.

Figure 6A:
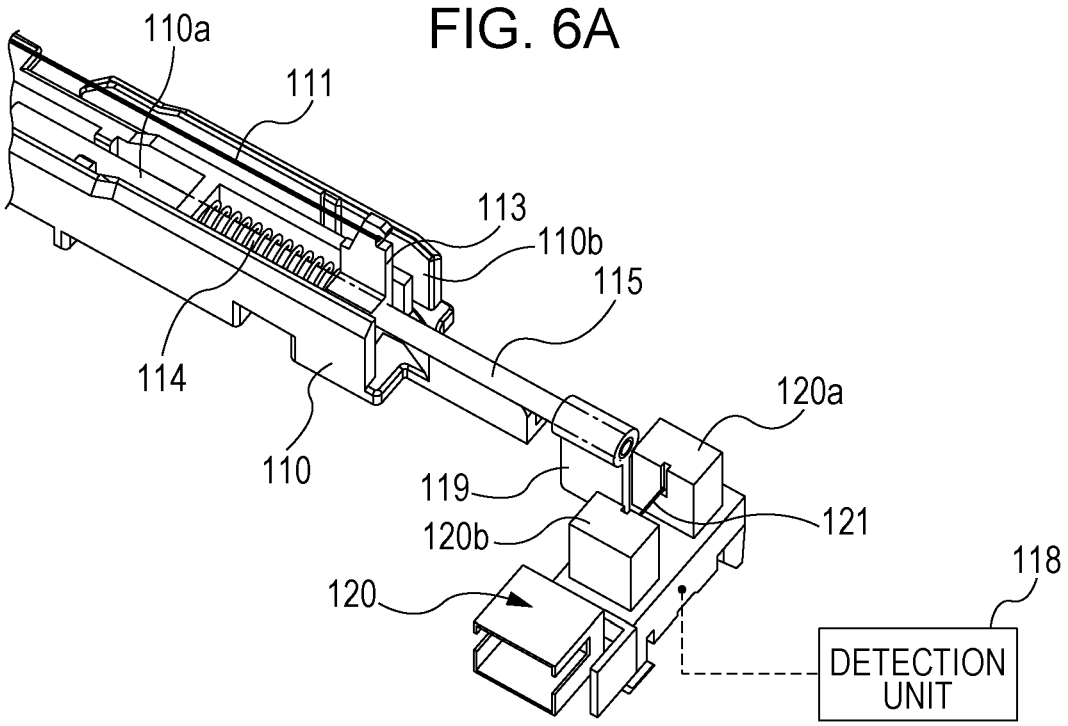
FIGS. 6A and 6B are perspective views of a cut detection mechanism, respectively, illustrating a set state before cut detection and a state at the time of cut detection.
Figure 6B:
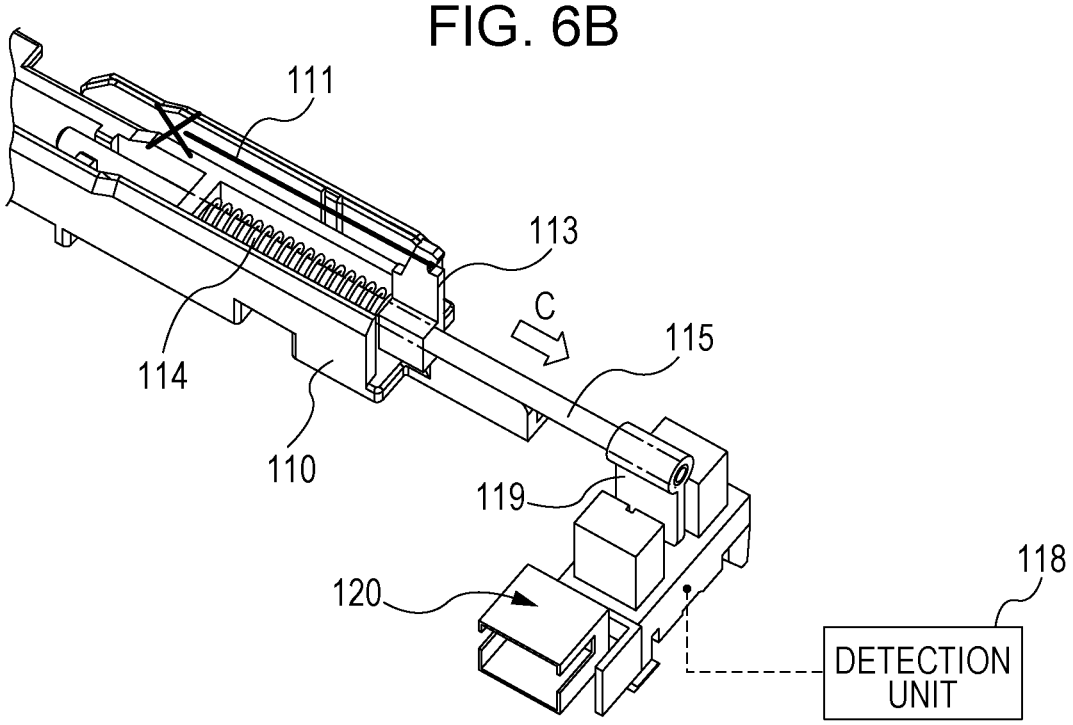

The members will be described in detail below with reference to FIGS. 5, 6A, and 6B. FIG. 6A is a perspective view illustrating a set state of the cut detection mechanism before cut detection, and FIG. 6B is a perspective view illustrating a state at the time of cut detection.

That is, the wire 111, which is laid near the inner peripheral surface of the fixing belt 101 and is cut, for example, by contact with a belt broken surface when the fixing belt 101 is broken, can be formed by a fine metallic wire of aluminum, copper, iron, or SUS having a diameter of 30 to 100 μm. Instead of the fine metallic wire, a heat-resistant fine resin wire or a sheet material can be used as the wire.

That is, while a wire-shaped conductive member is used as the wire 111 serving as the suspended member in this embodiment, an insulating member having insulation properties can also be used. Since any of the conductive member and the insulating member can be used as the suspended member in this way, the degree of flexibility in selecting the material to be used increases, and this provides a structural advantage of the device. Preferably, the wire 111 is formed by an electrically insulating member so as not to disturb the electric potential of the fixing belt 101.

As illustrated in FIG. 5, a suspension guide 110 is attached to the guide member 103 such as to extend in the longitudinal direction of the guide member 103. The fixed-side support member 112 holds one end of the wire 111 while being provided integrally with the suspension guide 110.

In contrast, as illustrated in FIGS. 6A and 6B, the movable-side support member 113 is fixed to a distal end portion (right end portion in FIGS. 6A and 6B) of a slider 115 serving as a moving member. The slider 115 is movably received in a guide groove 110*a* provided in a side of the suspension guide 110 close to the movable-side support member 113. Thus, the movable-side support member 113 is supported to be slidable in the longitudinal direction of the fixing belt 101. In the center of the guide groove 110*a*, a wall portion 110*b* is provided. The wall portion 110*b* has a through hole (not illustrated) that the slider 115 penetrates slidably.

While being fixed to the slider 115 penetrating the through hole, the movable-side support member 113 is biased by a coil-shaped compression spring 114 serving as a biasing member to apply tensile force to the wire 111 with a predetermined load F. The compression spring 114 is compressed between the wall portion 110*b* and a lower part of the movable-side support member 113. The compression spring 114 has an outer diameter more than an inner diameter of the through hole. The movable-side support member 113 is formed of an insulating material such as resin. The slider 115 that can slide in the longitudinal direction together with the movable-side support member 113 is formed by a conductive metallic member.

The above-described structure can remove slack from the wire 111, and can maintain a uniform gap between the fixing belt 101 and the wire 111 in the longitudinal direction. The detection unit (cut detection unit) 118 can detect a cut of the wire (suspended member) 111 from an operation in which one of the fixed-side support member 112 and the movable-side support member 113 serving as a pair of support portions (movable-side support member 113) separates from the other (fixed-side support member 112).

While the suspension guide 110 supports the fixed-side support member 112 and supports the movable-side support member 113 slidably in the embodiment, it may be replaced with an appropriate structure having this function.

Next, a structure for detecting a breakage of the fixing belt 101 will be described with reference to FIGS. 1, 3, 5, 6A, and 6B.

As illustrated in FIG. 5, the wire 111 is supported at both ends by the fixed-side support member 112 and the movable-side support member 113, and the movable-side support member 113 receives a predetermined tensile force F from the compression spring 114. The movable-side support member 113 is formed of an insulating material such as resin.

The slider 115 serving as the moving member (slide member), which slides together with the movable-side support member 113, penetrates the fixing flange 104 (see FIG. 3), and extends to a position near a photointerrupter 120 disposed on an outer side of the side plate 108 (see FIG. 3).

A flag (light shielding member) 119 fixed to the distal end of the slider 115 is protruded toward the photointerrupter 120 by a sliding action of the movable-side support member 113, and obstructs an optical path 121 (shields light). The optical path 121 is a path through which laser light emitted from a light emitting part 120*a* to an opposed light receiving part 120*b* in the photointerrupter 120 passes.

The photointerrupter 120 is connected to the detection unit 118 serving as the cut detection unit. When the detection unit 118 detects, on the basis of a sensor signal issued when the optical path 121 is obstructed by the flag 119, that the wire 111 is cut, it sends a detection signal to the controller 45. Thus, the controller 45 serving as the control unit recognizes (determines), according to the detection signal from the detection unit 118, that the fixing belt 101 is broken.

In a normal state in which the fixing belt 101 is not broken, the movable-side support member 113 stays at a predetermined position against the force of the compression spring 114 because the wire 111 is suspended (FIG. 6A). In this state, the flag 119 is located at a position such as not to obstruct the optical path 121. When the detection unit 118 detects that the photointerrupter 120 is not shielded from light, the controller 45 recognizes that the fixing belt 101 is not broken.

In contrast, when the fixing belt 101 is broken, a broken part contacts and cuts the wire 111 (a crossed portion in FIG. 6B). Hence, the movable-side support member 113 is slid in a direction of arrow C in FIG. 6B by the biasing force of the compression spring 114. Since the flag 119 moves in the same direction and obstructs the optical path 121, the detection unit 118 detects that the photointerrupter 120 is shifted into a light shield state.

Then, the controller 45 recognizes the occurrence of a breakage of the fixing belt 101 on the basis of the detection of the detection unit 118, and sends, to the driving unit 24 (FIG. 1), a command to stop the driving of the pressing roller 106.

Figure 7:
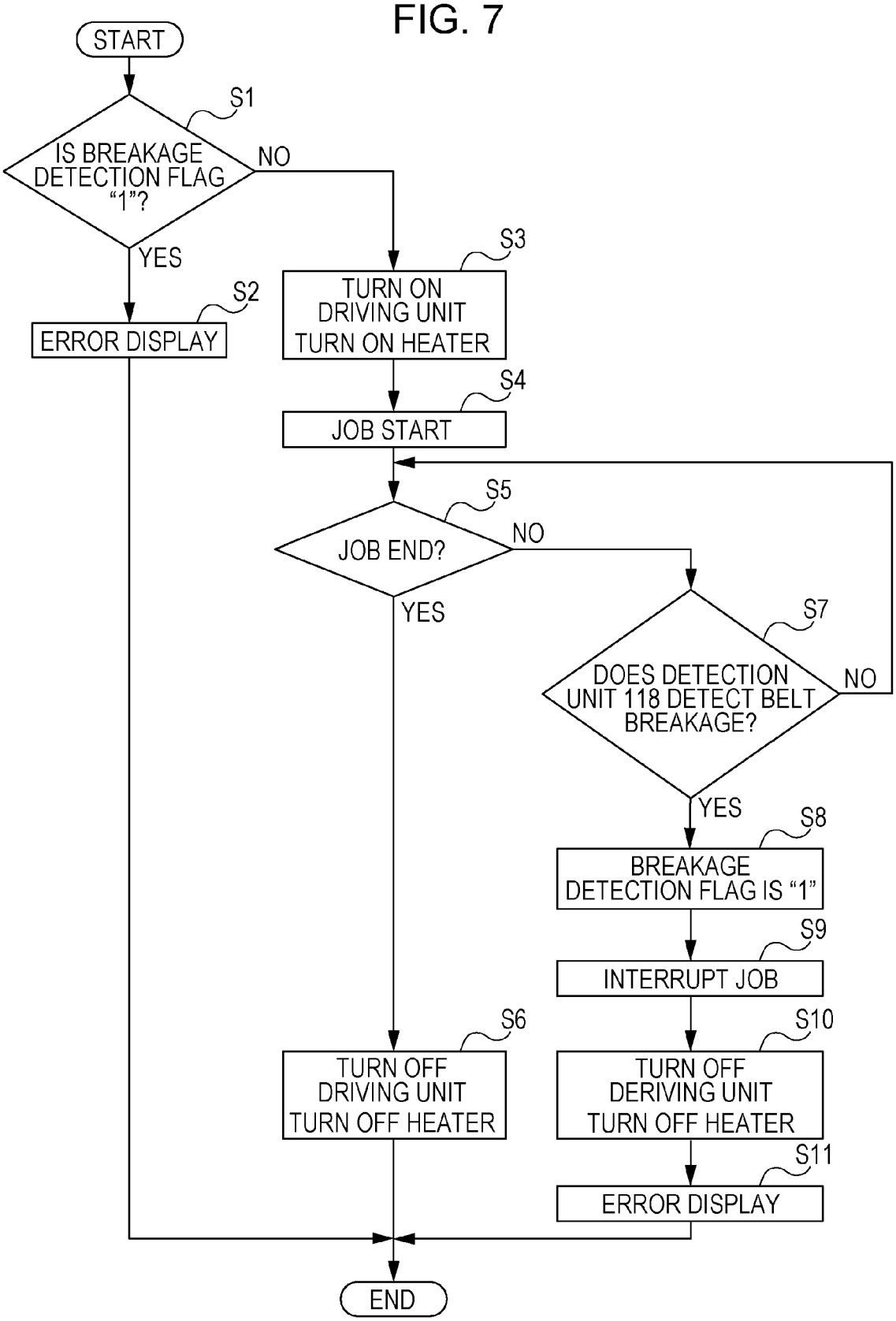
FIG. 7 is a control flowchart.

Next, an operation of recognizing a breakage of the fixing belt 101 will be described with reference to FIG. 7. FIG. 7 is a flowchart showing an operation of the image forming apparatus.

First, when a job start command is issued by the controller 45 formed by the CPU, breakage detection information (a breakage detection flag) stored in a memory is checked (Step S1). When the breakage detection information is "1", error display is performed (S2), reception of a job is prohibited, and the operation is finished.

In contrast, when the breakage detection information is "0", the controller 45 turns on the driving unit 24 to rotate the pressing roller 106, turns on the ceramic heater 100 to start heating (S3), and starts a job (S4).

In a normal state in which the fixing belt 101 is not broken, the job is executed until a job end signal is sent from the controller 45. When the job end signal is sent (S5), the rotation of the pressing roller 106 is stopped by the driving unit 24, heating with the ceramic heater 100 is stopped (S6), and the operation is finished.

In contrast, when the detection unit 118 detects a breakage of the fixing belt 101 between the job start (S4) and the job end (S5), the controller 45 determines that the fixing belt 101 is broken (S7), and stores breakage detection information "1" in the memory (S8). Then, the active job is immediately interrupted (S9), the driving unit 24 is turned off to stop the rotation of the pressing roller 106, the ceramic heater 100 is turned off to stop heating (S10), error display is performed (S11), and the operation is finished.

As described above, the embodiment adopts the flag (light shielding member) 119, and the photointerrupter (photosensor) 120 that is brought into a light shielded state when the flag 119 enters the photointerrupter 120 and into a light receiving state when the flag 119 separates from the photointerrupter 120. The detection unit (cut detection unit) 118 detects a cut of the wire 111 on the basis of the fact that the photointerrupter 120 is brought into the light shielded state when the flag 119 moves relative to the photointerrupter 120. The movement relationship between the flag 119 and the photointerrupter 120 can be the reverse of the above. Even when the photointerrupter 120 is moved relative to the flag 119 by changing the support structure, similar advantages can be obtained.

Figure 8A:
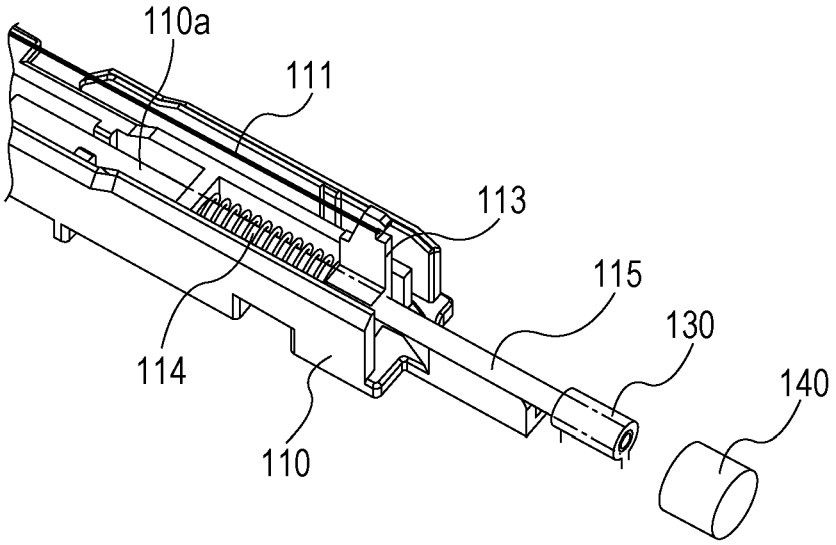
FIGS. 8A and 8B are perspective view of another cut detection mechanism, respectively, illustrating a set state before cut detection and a state at the time of cut detection.
Figure 8B:
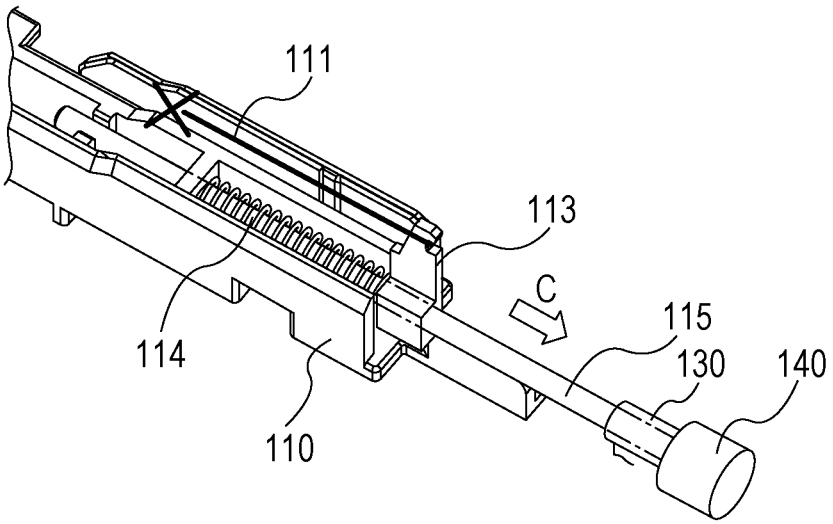

While the occurrence of a breakage of the fixing belt 101 is detected by the flag 119 and the photointerrupter 120 in the embodiment, it is satisfactory as long as the structure can detect that the movable-side support member 113 is moved, and a structure illustrated in FIGS. 8A and 8B can also be adopted. FIGS. 8A and 8B are perspective views of a cut detection mechanism, respectively, illustrating a set state before cut detection and a state at the time of cut detection. Members having functions similar to those in FIGS. 6A and 6B are denoted by the same reference numerals, and detailed descriptions thereof are skipped.

For example, when the slider 115 slides with the cut of the wire 111 (when a state of FIG. 8A is shifted to a state of FIG. 8B), a distal end portion 130 of the slider 115 pushes a microswitch 140 serving as a detector, whereby a breakage of the fixing belt 101 is determined. In this case, the microswitch 140 is connected to the controller (CPU) 45 via a signal line. When pushed, the microswitch 140 outputs a corresponding signal to the controller 45. The controller 45 controls the members along with the control flow of FIG. 7, similarly to the above. Other sensors may be used instead of the microswitch.

According to the above-described embodiment, the simple structure using the wire 111 as the suspended member can quickly and reliably detect a breakage of the fixing belt 101 only by detecting a cut of the wire 111. Thus, it is possible to immediately stop the rotation of the fixing belt 101 and to avoid trouble of the device due to the breakage of the fixing belt 101. Therefore, it is possible to make a prompt response when the breakage of the fixing belt 101 is detected, for example, it is possible to quickly stop the print operation or to quickly replace the fixing belt 101.

In the embodiment, the ceramic heater 100 for directly heating the fixing nip N is used as the heating mechanism. Alternatively, the fixing belt 101 can be heated by radiant heat from a halogen heater. Further alternatively, an IH (electromagnetic induction heating) type heating mechanism can be used to subject the fixing belt 101 to electromagnetic induction heating. In the IH type, a magnetic-flux generation mechanism, which generates magnetic flux for subjecting the fixing belt 101 to electromagnetic induction heating, serves as the heating mechanism.

In this way, even when any of the above-described mechanisms is used as the heating mechanism, the present invention can be applied by disposing the wire 111 near the peripheral surface of the fixing belt 101 and providing the detection unit 118 for detecting that the wire 111 is cut.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-056225 filed Mar. 19, 2013, which is hereby incorporated by reference herein in its entirety.

What is claimed is:

1. An image heating device comprising:

a belt configured to heat an image on a sheet;

a wire stretched from one widthwise end to the other widthwise end of the belt near a peripheral surface of the belt;

a moving member movably fixed to one end of the wire;

a biasing member configured to bias the moving member;

a detection unit configured to detect that the moving member is moved by a biasing force of the biasing member with being cut of the wire; and a control unit configured to control, according to an output of the detection unit with regard to detecting that the moving member is moved, whether or not to prohibit an image heating process.

2. The image heating device according to claim 1, wherein the detection unit includes a light emitting part and a light receiving part, and wherein the control unit prohibits the image heating process when the moving member obstructs light traveling from the light emitting part to the light receiving part.

3. The image heating device according to claim 1, wherein the wire is stretched near an inner peripheral surface of the belt.

4. The image heating device according to claim 1, further comprising:

a rotating member configured to form, in cooperation with the belt, a nip where the image on the sheet is heated.

5. The image heating device according to claim 4, wherein the rotating member rotationally drives the belt.

6. The image heating device according to claim 1, further comprising:

a heating mechanism configured to heat the belt.

* * * * *